United States Patent [19]

Schlosser

[11] 4,302,181

[45] Nov. 24, 1981

[54] PIEZOELECTRIC IGNITER APPARATUS FOR GAS GRILL

[75] Inventor: Eric J. Schlosser, Lindenhurst, Ill.

[73] Assignee: Weber-Stephen Products Co., Arlington Heights, Ill.

[21] Appl. No.: 124,558

[22] Filed: Feb. 25, 1980

[51] Int. Cl.[3] ..... F23Q 3/00; F24B 3/00

[52] U.S. Cl. ..... 431/264; 431/277; 310/339; 361/260; 126/25 B; 126/39 E

[58] Field of Search ..... 431/255, 264, 270, 267, 431/277; 219/267, 268; 361/260; 44/35, 36; 310/339; 126/25 B, 139 E

[56] References Cited

U.S. PATENT DOCUMENTS

| | | | |
|---|---|---|---|
| 233,855 | 11/1880 | Hinks | 431/270 |
| 450,483 | 4/1891 | Doremus | 431/270 |
| 1,108,970 | 9/1914 | Chevallard, Jr. | 431/270 |
| 2,505,596 | 4/1950 | Weiler | 431/264 |
| 3,558,938 | 1/1971 | Good | 361/260 X |
| 3,592,179 | 7/1971 | Hahn | 431/263 X |
| 3,817,684 | 6/1974 | Sell | 431/277 X |

*Primary Examiner*—Samuel Scott
*Assistant Examiner*—Randall L. Green
*Attorney, Agent, or Firm*—Robert E. Wagner; Leo J. Aubel

[57] ABSTRACT

The piezoelectric generator and the spark electrodes are assembled as an integral unit, the electrodes being at the upper end of the unit and projecting upwardly while the actuating button of the current generator projects downwardly from the lower end of the unit. The unit is movable vertically. When upward pressure is exerted on the button the unit moves to an upper position at which the electrodes are adjacent the gas burner and upon reaching that position continued upward pressure on the button actuates the current generator. When the button is released the unit descends by gravity to a lower position at which the electrodes are spaced away from the flame of the burning gas.

5 Claims, 3 Drawing Figures

PIEZOELECTRIC IGNITER APPARATUS FOR GAS GRILL

BACKGROUND AND SUMMARY OF THE INVENTION

The invention relates to a piezoelectric igniter unit for a gas burner, particularly a gas fired barbecue grill.

More and more people are using gas fired barbecue grills, particularly as a result of their convenience. Such grills have an outer shell forming a firebox and cooking enclosure, with the gas burner being located at the inside of this shell adjacent its bottom. This is not a convenient location for access to ignite the gas by means of a match or the like and it is quite common for the manufacturer to incorporate a piezoelectric powered igniter apparatus which includes a pair of spaced electrodes adjacent the burner. When the piezoelectric generator is actuated, as by means of pressing a button or turning a handwheel, a spark is produced at the electrodes for the purpose of igniting gas emanating from the burner. It is common to locate the piezoelectric current generator at a location somewhat remote from the electrodes which are affixed in place adjacent the burner. A location for the current generator is selected such that it will be convenient to operate as the gas is turned on and the current generator is connected by suitable wires to the electrodes.

There are several disadvantages to such devices conventionally being used. Perhaps the most important is the deleterious effect caused by the heat of the gas flame during the time that it is burning for the purpose of barbecuing or other cooking. The electrodes, being necessarily immediately adjacent or even in the flame because of the necessity for their being at that location for the ignition of the gas, deteriorate comparatively rapidly. The relatively high temperatures to which they are subjected causes oxidation, etc., of the electrodes. Also, the part of the wiring adjacent its connection to the electrodes necessarily is in a location of relatively high heat, both as a result of radiation from the flame and as a result of the conduction of the heat through the electrodes to the wiring. Despite efforts to shield the wiring, it is quite difficult to prevent deterioration of the insulation about the wires.

Another disadvantage that is oftentimes present is the length of the wiring between the current generator and the electrodes. Piezoelectric generators of the type employed do not generate a great deal of electricity and the longer the wires between the generator and the electrodes the greater will be the electrical loss in those wires. The result can be that the amount of electricity available at the electrodes may be rather marginal from the standpoint of producing a spark which will be sure to ignite the gas. In a particular configuration of barbecue grill it may seem important to the manufacturer to mount the current generator at a particular location for convenience, but that location may be rather remote from the electrodes.

I have devised a piezoelectric igniter apparatus to overcome these problems without impairing the convenience of using the igniter apparatus. A push-button actuated piezoelectric current generator is mounted on a subframe with the push-button thereof extending outwardly away from the firebox housing and the electrodes on the other end of the subframe projecting toward the firebox housing. This subframe is movable along a path such that the electrodes project through an opening into the housing and are located adjacent the burner when a force is applied against the push-button in a direction such as to normally actuate it. When the subframe reaches this location and can move no farther, that force results in a depression of the button to cause the generation of electric current and thus a spark. Means are provided to urge the subframe in the opposite direction so that when the push-button is released that means causes a retraction motion of the subframe with the result that the electrodes are moved away from the position adjacent the burner and to a location at which they will be much less subjected to the heat of the burner. The piezoelectric unit and the wiring to the electrodes being on the subframe and completely outside of the firebox housing are not subjected to any significant radiant heat. Furthermore, the piezoelectric unit and the electrodes are relatively close together on the subframe with the result that the wiring therebetween is of a minimum length.

Further objects and advantages will be apparent from the following description taken in conjunction with the drawings.

DESCRIPTION OF SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figure 1:
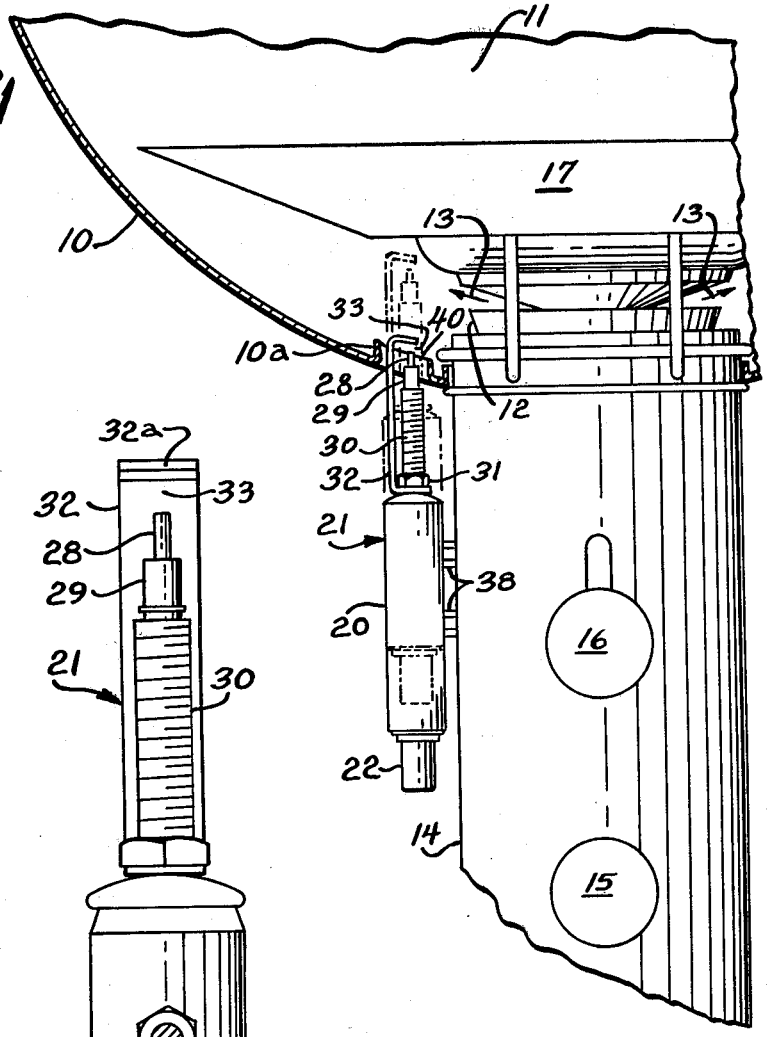
FIG. 1 is a section vertically through a portion of the cooking housing of a barbecue grill, showing the gas burner employed therein and an embodiment of the invention employed in conjunction therewith.

FIG. 1 illustrates, in vertical section, a portion of a barbecue grill presently being commercially marketed. It comprises a housing 10, commonly referred to as a kettle. It defines an internal chamber 11, which might be referred to as a firebox, within which there is a source of heat to do the cooking or barbecuing on an upper grill, not shown. In the type of barbecue apparatus to which the present invention relates, the source of heat is a gas flame. Thus there is a gas burner 12 from which gas emanates as indicated by arrows 13 to be burned in a flame. Within a central, annular supporting post 14 is a gas supply line (not shown) for burner 12 which supply line includes a gas valve controlled by a knob 15. There is also a knob-like handle 16 for adjusting and setting the position of a deflector 17. This described barbecue grill is merely illustrative of a gas fired device with which the present invention may be used and it will be obvious from the description herein that the invention may be applied to numerous other gas fired devices. In each instance there will be some sort of a frame, which in the illustrated embodiment comprises the housing 10 and the mounting post 14, which frame defines a firebox within which there is a gas burner.

The igniter apparatus of the present invention includes a subframe formed by an annular shell 20. An electrode assembly generally 21 (sometimes referred to as a spark plug) projects from one end of this subframe and the push-button 22 of a piezoelectric current generator 23 projects from the other end of the subframe. Of course, both are securely attached to the subframe. Such piezoelectric current generators are a standard catalog item with a number of manufacturers and need not be described in detail. Such commercially available items include Model SU 5 made by NGK Sparkplug Company, Ltd. of Nagoya, Japan, and Model 1174 made by Construction Electriques RV of LePuy, France. When the button 22 is pushed into the main part of the current generator (a predetermined force being required, which may vary from igniter to igniter depending upon the internal spring which urges the button to its outward position), there is an impact on a piezoelectric crystal (not shown) which generates an electric current in the wires 24 and 25 leading from the current generator.

The electrode assembly 21 comprises an axial electrode 28 fixed in an annular insulator 29. In turn the insulator is held in an annular, threaded bushing 30. A pair of nuts 31 threaded onto the bushing secure the electrode assembly to end cap 20*a* of the subframe. They also hold the exterior or grounded electrode 32. This electrode has an outer end 32*a* which projects over the distal end of the axial electrode 28. Wire 24 connects to the axial electrode 28 while wire 25 connects to the grounded electrode 32. When the piezoelectric generator 23 is actuated as above described and an electric current is generated in wires 24 and 25, a spark will occur across gap 33.

The subframe 20 is mounted on post 14 of the main frame by a carrier means which permits a limited range of movement of the subframe with respect to the post. Thus there is a way defined by the walls of the post about slot 36 therein. A carriage or traveler secured to the subframe is received in this way thereby guiding the subframe for limited movement along a generally vertical path. In the illustrated embodiment this traveler or carriage is formed by a pair of posts, more specifically two bolts 37. Each bolt is held to the subframe by a nut 38. This nut also bears against the exterior of post 14 and nuts 39 on the distal ends of the bolts bear against the interior face of post 14. The housing 10 is provided with an opening 40 aligned with the path of movemebt of the electrode assembly. The housing forms an annular flange 10*a* about this opening.

Figure 2:
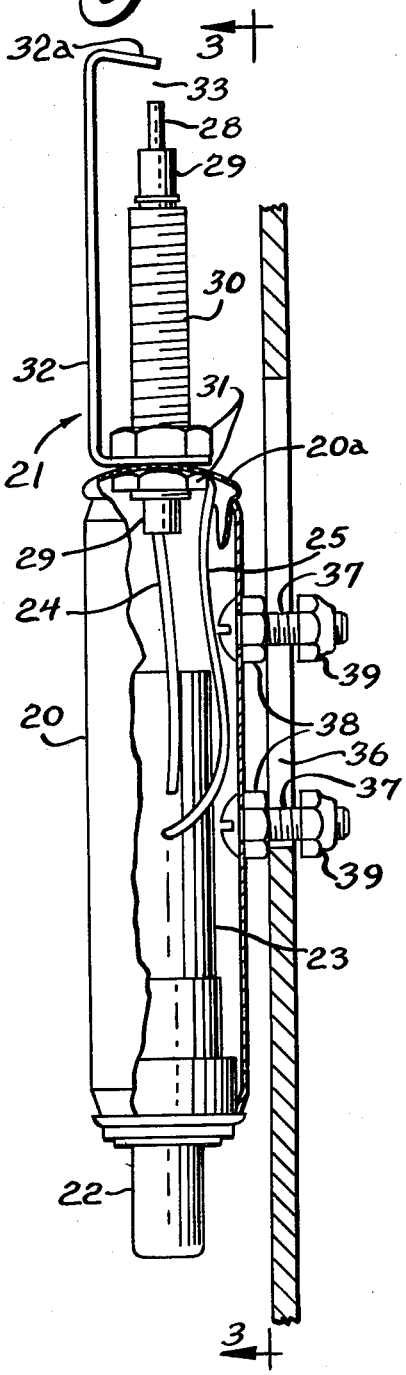
FIG. 2 is an enlarged view of the igniter apparatus as seen in FIG. 1, with portions broken away, and illustrating the mounting therefor.
Figure 3:
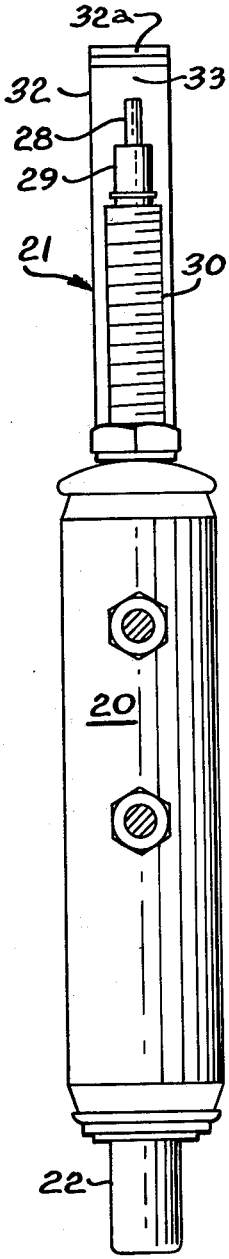
FIG. 3 is a view of the igniter apparatus as seen at line 3—3 of FIG. 2.

The extent of movement of the subframe is limited between a first position at which the lower bolt 37 abuts the post wall at the bottom of slot 36 and a second, upper position at which the upper bolt 37 abuts the post wall at the top of the slot. Biasing means is provided to urge the subframe to the first of these positions. In the illustrated embodiment this biasing means comprises the weight of the subframe, and the components mounted thereon, which under the pull of gravity causes the subframe to assume the position illustrated in FIG. 2 and in full lines in FIG. 1. The force of this biasing means should be less than the force required to actuate push-button 22. It will be obvious to those workers in the art that other forms of biasing means may be used, e.g., springs.

Assuming that the gas burner 12 is to be put into operation, a person would open the gas valve by an appropriate manipulation of knob 15. Immediately thereafter the person would, by means of finger pressure, push upwardly on button 22. The upward force thus applied to button 22 would initially cause the subframe to move to its upper position, illustrated in dashed lines in FIG. 1. It will be seen that in this upper position the spark gap 33 is immediately adjacent the path of the gas flow from burner 12. Upon arriving at the upper position, and the movement of the subframe being arrested, the force being applied to push-button 22 would be effective to cause the push-button to move into the current generator whereupon an electric current would be produced by the current generator. This would, of course, ignite the gas emanating from the burner. Thereupon the person would release push-button 22 and as a result the biasing on the subframe would return the subframe to the position illustrated in full lines in FIG. 1. In this first or lowered position the electrode assembly 21 no longer is in the path of the flames from the burner and at least most of that electrode assembly is outside the firebox so that it is in contact with ambient air rather than the heated air in the firebox. In the illustrated embodiment only the outer end 32*a* of the grounded electrode would even be subjected to the radiant heat from the flame. If even that much heat was undesirable the way defined by slot 36 could be revised to permit the first position of the subframe to be at an even lower elevation than that illustrated. Not only are the wires 24, 25 not subjected to any substantial heat whatsoever, but they are very short as compared to the wiring being used in other igniter apparatus of which I am aware.

I claim:

1. In an igniter apparatus for use with a device having a frame and a gas burner mounted in said frame, which burner produces a flame from gas and wherein the apparatus includes a piezoelectric current generator having a push-button and which when pressed by a given force in a given direction moves along a line to cause the generator to produce an electric current, electrode means for being positioned at a given location at which gas will be ignited when there is a spark at the electrode means, and wire means connecting the generator and the electrode means for conducting the current to the electrode means for producing a spark at the electrode means, the improvement comprising:

a subframe;

carrier means interconnecting the frame and the subframe and guiding the subframe for movement along a given path in a first direction from a first position to only a second position and for movement along said path in a second direction from said second position to said first position;

said subframe being urged in said second direction to said position by a predetermined force, said predetermined force being less than said given force;

said generator being mounted on said subframe with said line of button movement generally parallel to said path and said given direction generally corresponding to said first direction;

said electrode means being mounted on said subframe in a position such that when the subframe is at said second position the electrode means is at said given location and when the subframe is at said first position the electrode means will be displaced from said given location and spaced a significant distance from said flame;

whereby said subframe will normally be at said first position by reason of said urging but when said button is pressed in said given direction said subframe will first move to said second position and only upon reaching there the pressure on the button will be effective to depress the button resulting in a spark at the electrode means.

2. In an apparatus as set forth in claim 1, wherein said given path is generally vertical with said second position and is above said first position, and said subframe has upper and lower ends, said button being adjacent said loser end and projecting downwardly, and said predetermined force comprises the weight of the subframe, the generator and electrode means, which weight is acted on by the pull of gravity.

3. In an apparatus as set forth in claim 2 and wherein said frame includes a member defining a firebox, said gas burner being in said firebox, the further improvement comprising:

said member having an opening above and in substantial vertical alignment with said path;

said subframe being outside said firebox;

said electrode means projecting upwardly from said upper end and extending through said opening and into said firebox when said subframe is in the second position.

4. In an apparatus as set forth in claim 3 and wherein said frame includes a support post extending downwardly from said firebox defining member, the further improvement comprising:

said post having walls defining a vertical slot forming a way;

post means extending through said slot and forming a traveler movable in said way and aligned thereby;

said way and traveler forming said carrier means.

5. In an apparatus as set forth in claim 1 and wherein said frame includes a member defining a firebox, said gas burner being in said firebox, the further improvement comprising:

said subframe having an end adjacent said firebox and an end remote from said firebox;

said member having an opening substantially in alignment with said path;

said push-button being adjacent said remote end with said given direction being toward said firebox;

said electrode means extending from said adjacent ena and being within said firebox when said subframe is in the second position.

* * * * *